US011673411B2

(12) United States Patent
Barberan Latorre

(10) Patent No.: US 11,673,411 B2
(45) Date of Patent: Jun. 13, 2023

(54) HEAD, MACHINE, AND METHOD FOR DIGITAL PRINTING ON SUBSTRATES

(71) Applicant: Jesus Francisco Barberan Latorre, Castelldefels (ES)

(72) Inventor: Jesus Francisco Barberan Latorre, Castelldefels (ES)

( * ) Notice: Subject to any disclaimer, the term of this patent is extended or adjusted under 35 U.S.C. 154(b) by 20 days.

(21) Appl. No.: 17/617,762

(22) PCT Filed: Jul. 10, 2020

(86) PCT No.: PCT/ES2020/070448
§ 371 (c)(1),
(2) Date: Dec. 9, 2021

(87) PCT Pub. No.: WO2021/009400
PCT Pub. Date: Jan. 21, 2021

(65) Prior Publication Data

US 2022/0242144 A1 Aug. 4, 2022

(30) Foreign Application Priority Data

Jul. 18, 2019 (EP) ..... 19382609

(51) Int. Cl.
*B41J 11/00* (2006.01)

(52) U.S. Cl.
CPC .... *B41J 11/00214* (2021.01); *B41J 11/00216* (2021.01); *B41J 11/00218* (2021.01)

(58) Field of Classification Search
CPC ..... B41J 11/00214; B41J 11/00216; B41J 11/00218; B41J 2/14; B41J 2/01; B41J 3/543; B41J 29/17
See application file for complete search history.

(56) References Cited

U.S. PATENT DOCUMENTS

2005/0104946 A1 5/2005 Siegel
2009/0021549 A1 1/2009 Muto
2015/0151553 A1* 6/2015 Cofler ..... B41J 3/28 347/102

FOREIGN PATENT DOCUMENTS

CA 2552820 A1 7/2005

OTHER PUBLICATIONS

International Search Report for Corresponding International Application No. PCT/ES2020/070448 (2 Pages) (dated Oct. 8, 2020).

* cited by examiner

*Primary Examiner* — Bradley W Thies
(74) *Attorney, Agent, or Firm* — Lucas & Mercanti, LLP

(57) ABSTRACT

A digital print head, a digital printing machine having the head, and a method for digital printing on substrates using the head, the digital print head having an ejector for ejecting a product onto the substrate; a drying element for acting on the product ejected onto the substrate such that it is dried; and shielding element to prevent the ejected product from directly reaching the drying element by spray. Likewise, the drying element is located with respect to the ejector in such a way that when the product is ejected it may be subjected to the drying that may be provided by the drying element.

15 Claims, 7 Drawing Sheets

HEAD, MACHINE, AND METHOD FOR DIGITAL PRINTING ON SUBSTRATES

CROSS REFERENCE TO RELATED APPLICATION

This Application is a 371 of PCT/ES2020/070448, filed on Jul. 10, 2020, which claimed priority of European Application No. 19382609.6, filed Jul. 18, 2019, which are incorporated herein by reference.

FIELD OF THE ART

The present invention relates to the industry dedicated to printing on substrates by means of digital printing technology, and more specifically to the industry dedicated to ejecting and drying said prints.

STATE OF THE ART

Digital prints are known to be made today on substrates with the substrates being configured by way of panels and being made of a material that can be selected, for example, from wood (particle board, medium-density fiberboard "MDF," high-density fiberboard "HDF," or plywood), plastic (PVC), cellulose-based materials (paper or cardboard), and metal.

For the purpose of obtaining better results in relation to print quality, i.e., image resolution, while at the same time being able to provide a high print speed, print heads having both product ejectors and curing elements are used today. The curing elements are radiation emission sources, such as for example UV, UV-LED, infrared, etc.

The curing elements are therefore arranged in proximity with respect to the ejectors such that the products ejected by same can be subjected immediately to at least partial curing of the said products.

However, this arrangement entails significant drawbacks precisely as a consequence of said proximity between the ejectors and the curing elements.

When the products are ejected by the print heads through the ejectors, this ejection is done in a rectilinear manner, i.e., according to the direction and sense defined by said ejector. Nevertheless, ejection through the ejectors entails the ejected products being sprayed, though at a very low percentage that is virtually imperceptible to the human eye, but it does happen. This spray can be defined by a separation or deviation of microdroplets comprising volumes of a few picoliters with respect to the rectilinear path of the ejections.

This spray causes unwanted contamination of locations other than those corresponding to ejection points in each of the ejections. Likewise, the spray causes the products to be arranged on the mentioned curing elements.

According to this, and since these are elements which furthermore perform curing of the ejected products, the curing elements become undesirably stained or covered by the sprayed products such that the curing or drying at the ejection points on the substrates is impaired from the viewpoint of efficacy and uniformity.

The print speeds and print qualities are directly conditioned by the soiling of the curing elements, by the efficacy and uniformity offered during use thereof, as well as by necessary operating or printing shutdowns in order to clean said elements.

In view of the described drawbacks or limitation of the solutions existing today, a solution is needed which allows arranging the curing elements in proximity with respect to the ejection nozzles, while at the same time providing efficacy and uniformity over time, and eliminating the necessary printing shutdowns for cleaning said curing elements.

OBJECT OF THE INVENTION

For the purpose of meeting this objective and solving the technical problems discussed up until now, in addition to providing additional advantages which can be derived below, the present invention provides a digital print head and a digital printing machine for printing on substrates comprising the digital print head, in addition to a method for digital printing using said digital print head and/or said digital printing machine.

The digital print head for printing on the substrates comprises an ejector for ejecting a product onto the substrate and a drying element for acting on the product ejected onto the substrate such that it is dried or cured.

The present digital print head additionally comprises shielding means to prevent the ejected product from directly reaching the drying element by spray.

According to this, the drying element is located with respect to the ejector in such a way that when the product is ejected it may be subjected to the drying or curing that can be provided by the drying element.

Preferably, the drying element is a UV, UV-LED, or infrared radiation emission source.

The shielding means may comprise an air pump for blasting air or generating an airstream, such that when the sprayed product is ejected it can be deviated with respect to the curing element. According to this, the air pump is configured for generating the blast of air, or the airstream, by blowing or by suction.

In addition or as an alternative to the air pump, the shielding means may comprise an electric charge generator for generating a static charge such that when the sprayed product is ejected it can be deviated with respect to the curing element.

In addition or as an alternative to the air pump and/or the electric charge generator, the shielding means may comprise a barrier element arranged in correspondence with the drying element such that it may be reached by the sprayed product when it is ejected.

The barrier element is preferably configured for receiving the spray of the ejected product and for allowing the drying element to act on the product ejected onto the substrate.

Optionally, the shielding means comprise a frame for carrying the barrier element and for being arranged supported on the base.

The barrier element is rigid, being made of a material that can be selected from crystal, glass, and plastic. Alternatively, the barrier element is made of a plastic material, preferably polyethylene terephthalate (PET), and is configured such that it is elastically deformable.

According to the elastic deformation capacity of the barrier element, the barrier element is arranged such that it can be fed by being unwound and wound for being arranged and removed, respectively, with respect to the drying element. Alternatively, also according to the elastic deformation capacity of the barrier element, the barrier element is arranged such that it can be fed according to a closed path.

In addition or as an alternative to the air pump, the electric charge generator, and/or the barrier element, the shielding means may comprise a substance arranged for receiving the sprayed product, where the substance can be removably applied.

Preferably, when the barrier element is arranged such that it can be fed according to the closed path, the digital printing machine for printing on the substrates comprising the described digital print head, additionally comprises cleaning means configured for removing the sprayed product when it is ejected with respect to the barrier element. According to this, the cleaning means are configured for performing said removal continuously, i.e., according to the movement of the barrier element such that it is cleaned between successive movements in correspondence with the curing element.

The method for digital printing prints on substrates using the digital print head and/or the digital printing machine, as described for said head and said machine.

DETAILED DESCRIPTION OF THE INVENTION

Figure 1:
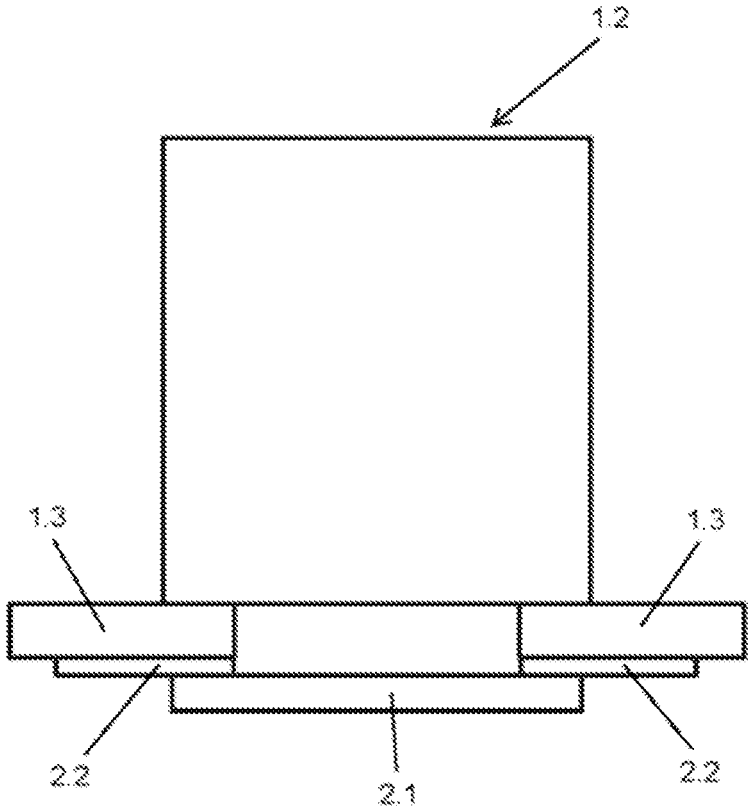
FIG. 1 shows a schematic view of a curing element and shielding means comprised in a digital print head object of the invention, according to one embodiment.

The present invention relates to a digital print head for printing on substrates, a digital printing machine comprising this digital print head, and a method for digital printing on substrates using said machine and, therefore, also said digital print head for printing on the substrates.

The substrates to be printed on or treated have a discontinuous or continuous format, i.e., they are elements that can be fed to the machine either individually and independently or else continuously such that they are, for example, extended or unwound from a wound or folded arrangement.

Likewise, the substrates can be made of various materials, comprising a material preferably selected from wood, for example according to medium-density fiberboards or "MDF," high-density fiberboards or "HDF," and particle board; HPL; plastic; composite; and cellulose derivatives such as, for example, paper and cardboard.

For the purpose of treating or printing on the corresponding substrates, the invention comprises ejecting preferably at least one product, more preferably at least two, and even more preferably at least three. The products to be ejected onto the substrate can be selected, for example, from a white ink by way of "priming," putty, varnish, glue or adhesive, printing ink, varnish, and lacquer.

For the purpose of treating or printing on the corresponding substrate by means of applying or ejecting one or more of the products, the machine comprises at least one digital print head, and preferably a set of them such that in addition to one, they can be two, three, four, or more in number. In turn, each of the digital print heads has at least one ejector (1.1) for ejecting the corresponding product onto the substrate.

For the purpose of obtaining high-resolution results and high-quality finishes when printing on or treating the substrates, the digital print heads have drying elements (1.2) configured for at least partially drying or curing the products ejected by the ejectors (1.1).

Likewise, the corresponding digital print heads have a base (1.3) to be arranged facing or parallel to a surface of the substrate to be printed. The ejectors (1.1) and the drying elements (1.2) project with respect to or from said base (1.3).

The drying elements (1.2) are preferably infrared, UV (ultraviolet), or UV-LED radiation emission sources. Alternatively, the drying elements (1.2) are radiation emission sources using ultrasounds or beta radiation in the form of electron irradiation (EBI) or electron beam processing. Therefore, the drying elements (1.2) are preferably lamps or light bulbs with glass or plastic by way of optical diffuser or bulb or the like.

According to an arrangement of the drying elements (1.2) with respect to the ejectors (1.1), from the moment the product is ejected by the corresponding ejectors, said ejected product can be subjected to complete or partial drying by the action of the corresponding drying elements (1.2). The ejection of each of the ejectors (1.1) can therefore be arranged on the substrate according to a desired state.

One of the desired states of the ejected product corresponds with an intermediate dried or cured state, which can also be referred to as the semi-dried or semi-cured state. In other words, the product ejected by the corresponding ejector (1.1) is partially cured or dried, without totally or completely hardening such that it is gelled.

Another one of the desired states of the ejected product corresponds with a final dried or cured state, which can also be referred to as a totally dried or totally cured state. In other words, the product ejected by the corresponding ejector (1.1) is totally or completely cured or dried such that it is dried or solidified in its entirety.

When the products are ejected by the digital print heads through the ejectors (1.1), this ejection is performed in a rectilinear manner, i.e., according to a direction and sense defined by said ejectors (1.1). However, ejection by the ejectors (1.1) entails the ejected products being sprayed, though at a very low percentage that is virtually imperceptible to the human eye, but it does happen. This spray can be defined by a separation or deviation of microdroplets, of the order of picoliters, with respect to the described rectilinear path of the ejections.

This spray causes unwanted contamination of locations other than those corresponding to ejection points that can be defined on the substrates. According to this, the sprayed product can reach the curing elements (1.2), and more specifically their optical diffuser or bulb, such that they are partially or completely covered during the ejections.

Likewise, given the action of the curing elements (1.2), the sprayed product is cured by the curing elements (1.2) therein. This takes place such that the sprayed product is completely cured. Furthermore, said curing occurs in a manner that can be considered almost immediately, since it can occur in a second or less, i.e., in tenths or even thousandths of a second.

As described in reference to the product that is sprayed and cured on the curing elements (1.2), and therefore interfering in their action, in addition to a complex and limited accessibility thereto, removal of the sprayed product with respect to the curing elements (1.2) is a complex issue. Spraying the ejected product entails a soiling or an obstacle to optimize the results of printing on the substrates given that the radiation they emit is hindered or blocked to a greater extent according to the increase in the number of ejections.

To optimize obtaining high-resolution results and high-quality finishes when printing on or treating the substrates, the digital print head comprises shielding means. These shielding means are configured and arranged to prevent part of the sprayed product from reaching or directly impacting the curing elements (1.2) during ejection.

According to a first preferred embodiment, the shielding means comprise at least one barrier element (2.1) for receiving and retaining the sprayed product, the barrier element (2.1) additionally being configured for the passage of the radiation emitted by the curing elements (1.2) such that the products ejected onto the substrates can be cured or dried. According to this, the barrier elements (2.1) are preferably configured such that they are partially transparent, and more preferably completely transparent, to the radiation emitted by the curing elements (1.2).

Likewise, the barrier elements (2.1) are configured for covering the curing elements (1.2). The barrier elements (2.1) are thereby arranged covering the curing elements (1.2) for receiving the sprayed product instead of said curing elements (1.2).

According to the first preferred embodiment, the barrier element (2.1) is a rigid element, i.e., not elastically deformable. It is defined as rigid according to a predominant behavior of the barrier element (2.1) since it will never be able to be absolutely rigid and will therefore deform, albeit imperceptibly to the human eye, under the action of loads acting on them. According to this, it is considered rigid in terms of idealization for the purpose of kinematics studies since this branch of mechanics only studies objects, not the external forces that act on them.

The barrier element (2.1) is therefore impact and friction resistant when it is, for example, placed, removed, and cleaned. In other words, the barrier element (2.1) is configured to facilitate the handling thereof, at least to a greater extent than the curing elements (1.2).

This rigid configuration or constitution of the barrier element (2.1) requires less contact as it is arranged supported on the digital print head, and more specifically the base (1.3) of said head.

The barrier element (2.1) is made of a material preferably selected from crystal, glass, and plastic, and more preferably it is made of quartz crystal or PET (polyethylene terephthalate).

According to a second preferred embodiment, the shielding means comprise the barrier element (2.1) for receiving and retaining the sprayed product, with the barrier element (2.1) also being additionally configured in this example for the passage of the radiation emitted by the curing elements (1.2) such that the products ejected onto the substrates can be cured or dried. According to this, the barrier elements (2.1) are preferably configured such that they are at least partially transparent to the radiation emitted by the curing elements (1.2).

Likewise, like in the first preferred embodiment, the barrier elements (2.1) are configured for covering the curing elements (1.2). The barrier elements (2.1) are thereby arranged covering the curing elements (1.2).

However, according to this second preferred embodiment, the barrier element (2.1) is elastically deformable, i.e., it is not rigid, as described for the first preferred embodiment. The barrier element (2.1) is preferably made of a plastic material. According to this, the barrier element (2.1) is made of a material preferably selected from polyethylene (PE), polypropylene (PP), and polyethylene terephthalate (PET).

Elastic deformation provides certain flexibility in the handling and use of the barrier element (2.1). The barrier element (2.1) can thereby be wound and folded, as well as unwound and unfolded.

According to both the first preferred embodiment and the second preferred embodiment, the shielding means may comprise a frame (2.2) for carrying the barrier element (2.1), preferably by fitting or adhesion (FIG. 1). The frame (2.2) is thereby used for arranging the barrier element (2.1) in the digital print head, and more specifically in the base (1.3) thereof. Preferably, the frame (2.2) is made of a metallic material, although it can alternatively be made of a plastic material.

According to a first possibility in relation to the frame (2.2), the frame (2.2) is configured such that it has through holes. One of the barrier elements (2.1) is arranged in each of the through holes, covering them.

Figure 5:
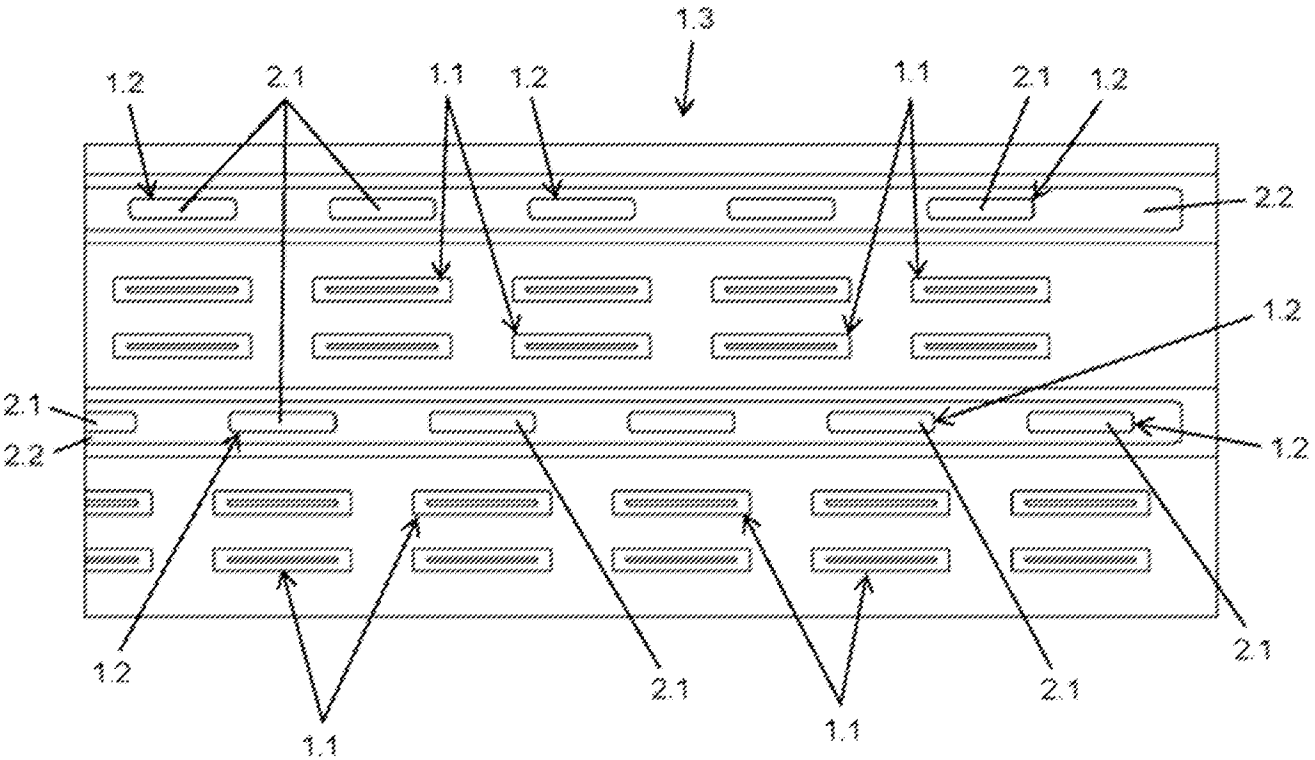
FIG. 5 shows a partial bottom schematic view of the digital print head, where the shielding means according to another additional embodiment can be seen.

The barrier element (2.1) of each of said through holes is configured for covering preferably one of the curing elements (1.2) comprised in the digital print head, as depicted in FIG. 5. Alternatively, the barrier element (2.1) of each of the through holes is configured for covering several of the curing elements (1.2) comprised in the digital print head.

According to a second possibility in relation to the frame (2.2), the frame (2.2) is configured such that it has a single through hole. The barrier element (2.1) is arranged in the single through hole of each of the frames (2.2), covering same.

Figure 4:
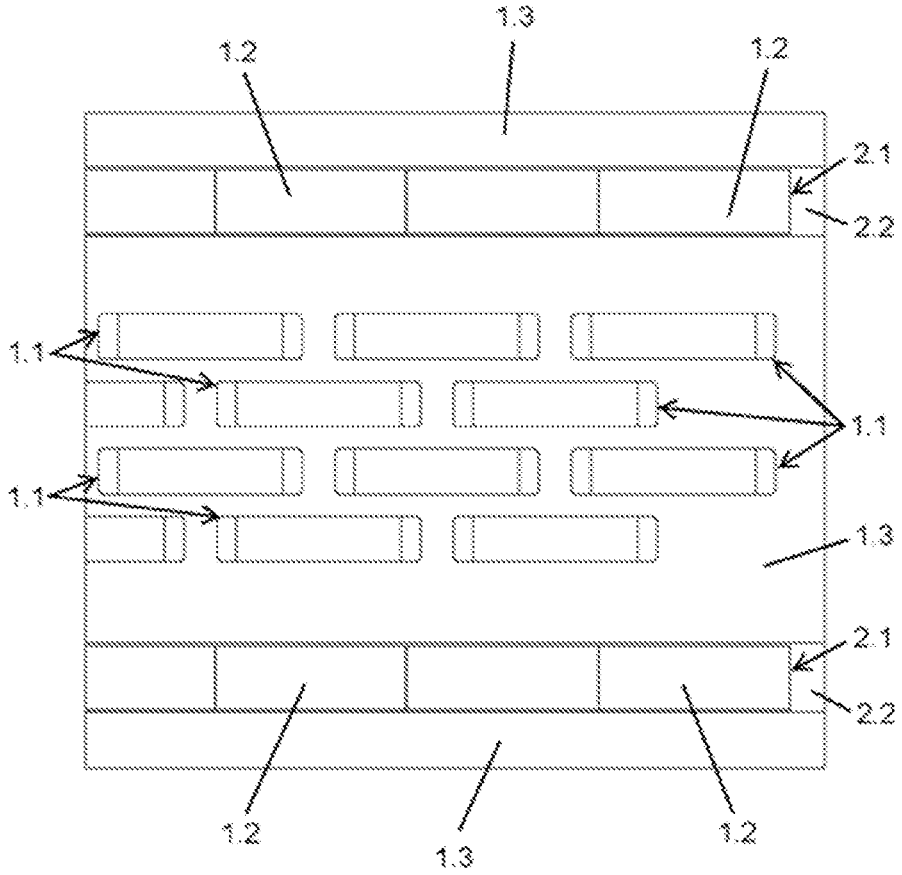
FIG. 4 shows a partial bottom schematic view of the digital print head, where the shielding means according to the additional embodiment can be seen.

The barrier element (2.1) of the corresponding single through hole is configured, in this case, for covering at least one of the curing elements (1.2) comprised in the digital print head, and preferably several of said curing elements (1.2). According to the configuration and the arrangement of the single through hole for covering several of the curing elements (1.2), said curing elements (1.2) are aligned at the base (1.3). See FIG. 4.

According to both the first preferred embodiment and the second preferred embodiment, the digital print head comprises placement means for arranging and supporting the shielding means in correspondence with the base (1.3) in a removable manner.

According to a first option in relation to the arrangement and support of the barrier element (2.1) in the digital print head, and more specifically in correspondence with the base (1.3) thereof, the placement means comprise at least one flat or similar element. Said placement means, not shown in the drawings, are configured so that they can be fixed directly in the present head, and more specifically in said base (1.3), preferably by means of a screwed arrangement.

Additionally, with the shielding means comprising the frame (2.2) according to the first or second possibility, said frame (2.2) is arranged for being seized by the mentioned placement means against the base (1.3) such that both the frame (2.2) and the barrier elements (2.1) carried by said frame (2.2) are supported.

Figure 2A:
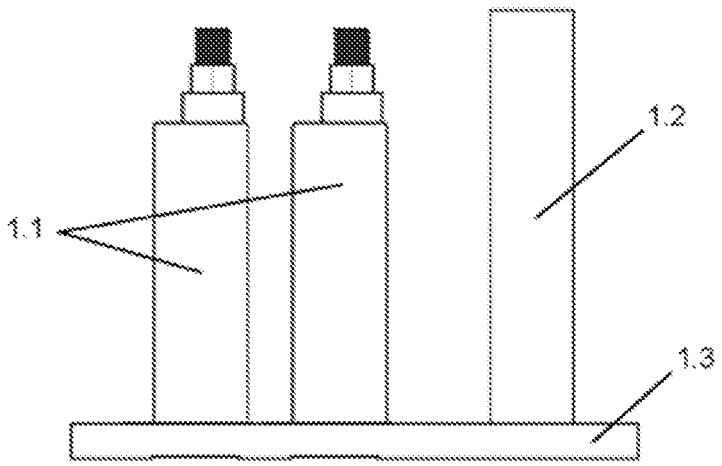
FIG. 2A shows a side schematic view of ejectors comprised in the digital print head and one of the curing elements.
Figure 2B:
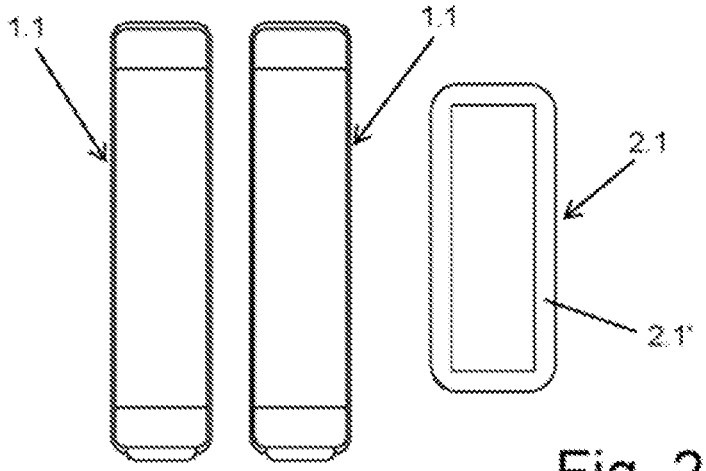
FIG. 2B shows a bottom schematic view of FIG. 2A, with the curing element being covered by the shielding means according to another embodiment.

When the shielding means are devoid of the frame (2.2), the barrier element (2.1) may comprise machining (2.1') to support same in the base (1.3) through the placement means as described above. According to this, the machining (2.1') of the barrier element (2.1) is to receive said flat or similar element, preferably by being configured by way of a recess having the thickness of the barrier element (2.1). See FIG. 2B.

According to a second option in relation to the arrangement and support of the barrier element (2.1) in the digital print head, and more specifically in correspondence with the base (1.3) thereof, the placement means comprise a groove (3.1, 3.2) specifically in correspondence with the base (1.3). The arrangement and support of the barrier element (2.1) by means of the groove (3.1, 3.2) is either direct as it is devoid of the corresponding frame (2.2), or indirect as the barrier element (2.1) is carried by the corresponding frame (2.2) at the time said frame (2.2) is in contact with the digital print head in correspondence with the groove (3.1, 3.2). According to this second option, the groove can be referred to as an open groove (3.1) or closed groove (3.2).

Figure 6:
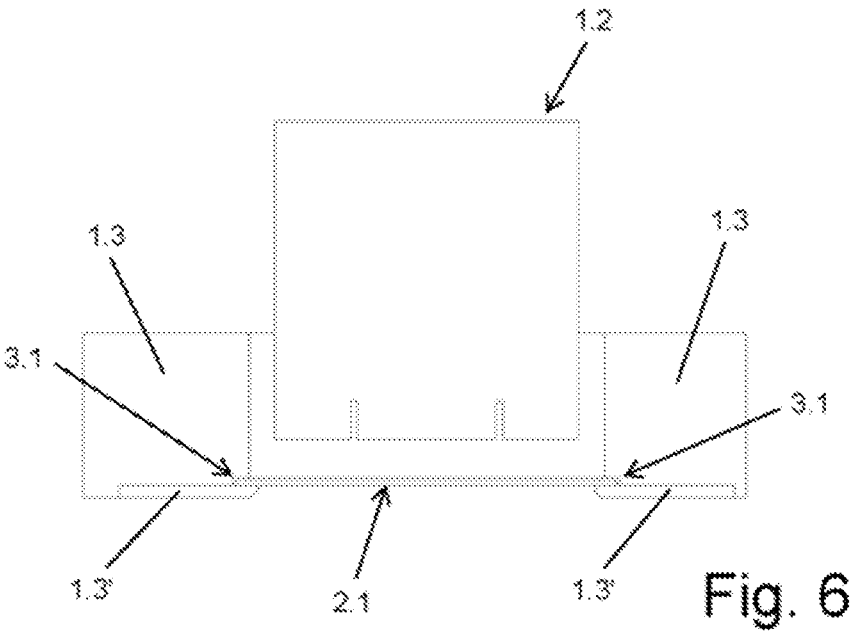
FIGS. 6 and 7 show front schematic views of the curing element, with the curing element being covered by the shielding means according to a further additional embodiment according to two placement options.

In the case of the open groove (3.1), FIG. 6, this open groove (3.1) is configured such that the barrier element (2.1) can be placed therein by means of a movement perpendicular to the base (1.3), and more specifically with only said movement perpendicular to the base (1.3) being required. Preferably, the open groove (3.1) is configured such that it has a "U"-shaped cross-section or sides forming an angle equal to or greater than 90° with respect to a bottom thereof.

Likewise, at least for this second option, the placement means additionally comprise at least one securing element (1.3'), and preferably at least two, for each of the open grooves (3.1). The corresponding securing elements (1.3') are arranged for supporting the barrier element (2.1) in the open groove (3.1). For this purpose, the securing elements (1.3') are configured for being arranged and removed preferably by fitting and prying loose, respectively, and more preferably by means of screwing in and unscrewing a threaded shaft, respectively. This securing element (1.3') is configured preferably by way of sheet metal, and more preferably by way of elongated sheet metal.

Figure 7:
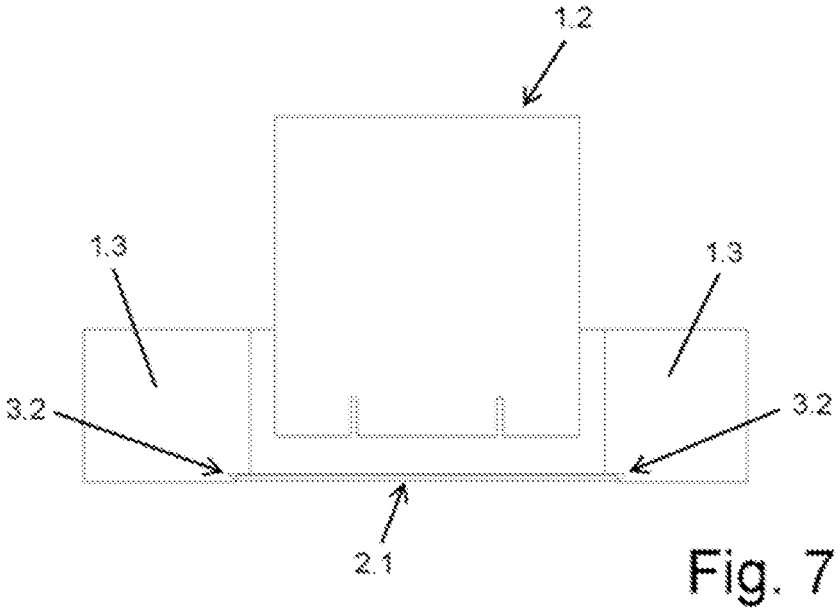

In the case of the closed groove (3.2), FIG. 7, this closed groove (3.2) is configured such that the barrier element (2.1) can be placed therein by means of a movement parallel to the base (1.3), blocking the possibility of being a barrier element (2.1) that can be placed therein by means of a movement perpendicular to the base (1.3). Preferably, the open groove (3.1) is configured such that its sides, or parts thereof, form an angle smaller or less than 90° with respect to the bottom thereof.

Said closed groove (3.2) is thereby configured such that the barrier element (2.1) is supported by the blocking or the sides, or parts thereof, forming the angle smaller or less than 90° with respect to the bottom thereof. In other words, the closed groove (3.2) is configured for housing and supporting the barrier element (2.1) without requiring additional elements like the previously mentioned securing elements (1.3'). Preferably, the closed groove (3.2) is configured such that it has a dovetail-shaped cross-section.

Figure 3:
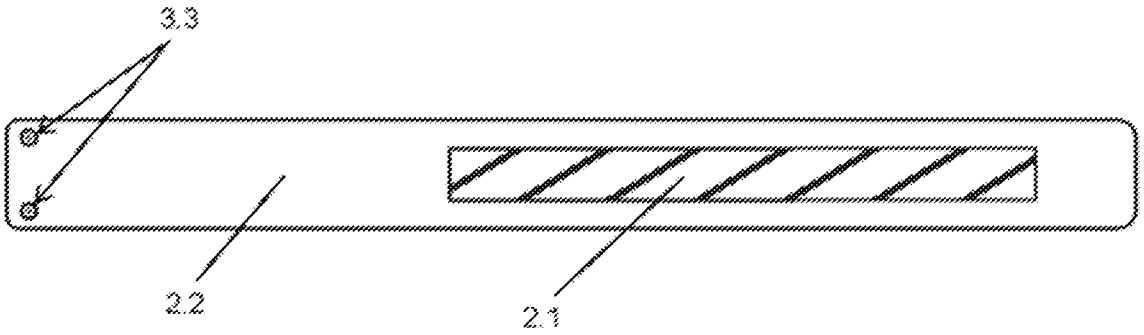
FIG. 3 shows a schematic view of the shielding means comprised in the digital print head according to an additional embodiment.

According to a third option in relation to the arrangement and support of the barrier element (2.1) in the digital print head, and more specifically in correspondence with the base (1.3) thereof, the placement means comprise screws (3.3) for a removable fixing. According to this, the screws (3.3) are arranged screwed into the base (1.3) either through the frame (2.2) or through the barrier element (2.1), with the shielding means comprising or not comprising the frame (2.2). See FIG. 3.

This third option can be combined with the previously described second option. The barrier element (2.1) is thereby supported, either directly or indirectly, by means of arranging the screws (3.3) in the groove (3.1, 3.2) and screwing them in.

According to the first preferred embodiment, the shielding means, i.e., the barrier element (2.1) and optionally also the frame (2.2) when said means additionally comprise the frame (2.2), have a preferably discontinuous format. Thereby according to said discontinuous format, said shielding means can be arranged and removed with respect to the digital print head in an individual and isolated manner.

According to the second preferred embodiment, the mentioned shielding means, i.e., the barrier element (2.1) and optionally also the frame (2.2) when said means additionally comprise the frame (2.2), have a discontinuous or continuous format, i.e., they can be arranged and removed with respect to the digital print head in an individual and isolated manner or by a movement thereof according to either a continuous movement or periodic movements.

Particularly where the shielding means have the described continuous format, the machine preferably comprises movement means for automating the movement of said shielding means, both when such movement is according to the continuous movement and when it is according to the periodic movements. The movement means comprise a motor, preferably an electric motor, for generating and transmitting a movement such that the shielding means are moved accordingly, and optionally also a controller for determining when to make each of the periodic movements and how long each should last, for actuating the movement means depending on the print speed and/or degree of soiling of the shielding means.

Figure 8:
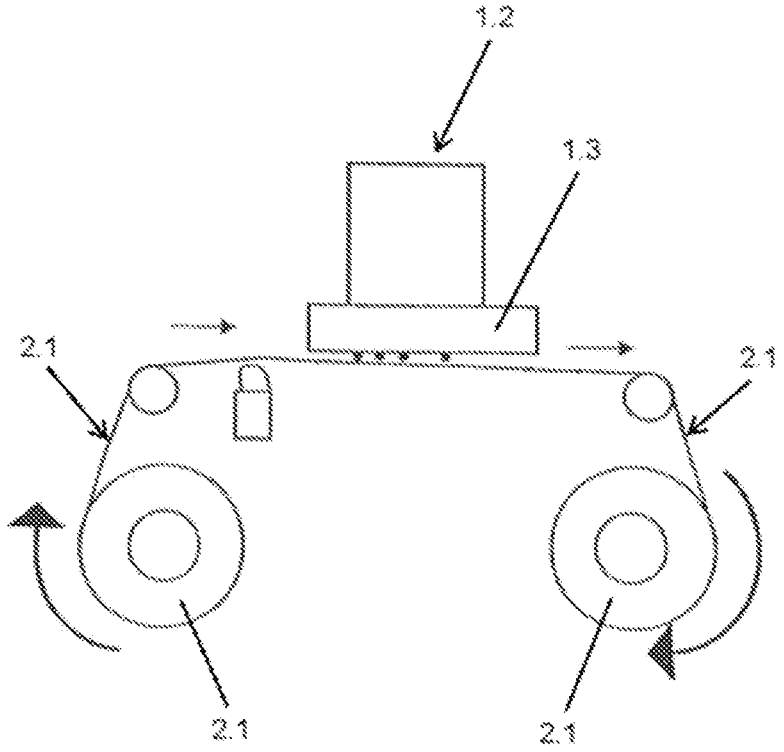
FIG. 8 shows a partial schematic view of the digital print head, where the shielding means according to the further additional embodiment can be seen.

According to a preference considering the described continuous format, the shielding means, i.e., the barrier element (2.1) and optionally also the frame (2.2) when said means additionally comprise the frame (2.2), are moved and unwound to prevent part of the sprayed product from reaching or directly impacting the curing elements (1.2) during ejection, and wound again. Therefore, the shielding means can be wound such that they are collected, for example, for later use, cleaning, or disposal thereof. See FIG. 8.

According to another preference considering the described continuous format, the shielding means, i.e., the barrier element (2.1) and optionally also the frame (2.2) when said means additionally comprise the frame (2.2), are moved following a closed path, i.e., endless or closed-loop mode.

According to at least this other preference, in a preferable manner, the machine additionally comprises cleaning means for cleaning said shielding means. According to this, said cleaning means are configured for performing said cleaning continuously, i.e., according to the movement of the shielding means.

The cleaning means, not shown in the drawings, are arranged and configured such that after each movement of each portion of the barrier element (2.1), and optionally also of the frame (2.2) when the shielding means additionally comprise the frame (2.2), in correspondence with the corresponding curing elements (1.2), each of said portions is cleaned of the impacted and retained sprayed product to receive more sprayed product in a new ejection.

These cleaning means are configured for removing, getting rid of, or eliminating the corresponding products from the shielding means. Said cleaning means are thereby configured for applying a solvent and preferably also for subsequent cleaning and drying, for example by means of rollers and blowers, or the like. Additionally or alternatively, said cleaning means are configured for using a scraper element such that the sprayed products are mechanically separated from the shielding means. In addition or as an alternative to one or both of these described configurations, the cleaning means are configured for applying ultrasounds.

According to a third preferred embodiment, the shielding means comprise an electric charge generator, not shown in the drawings, for generating a static charge. This static charge is generated with a polarity depending on the polarity of the corresponding product for deviating the spray of the ejected product with respect to the curing element (1.2). In other words, said static charge is generated for directing the sprayed product with respect to the curing element (1.2), such that the spray is received and retained in preselected parts of the head or of the machine other than the curing elements (1.2), in addition to the substrates.

According to a fourth preferred embodiment, the shielding means comprise an air pump, not shown in the drawings, for blasting air or generating an airstream. This airstream or this blasted air is for deviating the spray of the ejected product with respect to the curing element (1.2). In other words, the airstream or the blasted air is generated such that the sprayed product is deviated with respect to the curing element (1.2). Likewise, by means of this deviation provided by the air pump, the spray is received and retained in preselected portions of the head or of the machine other than the curing elements (1.2), in addition to the substrates.

According to this, the air pump is configured for acting preferably by suction. Alternatively, the air pump is configured for acting by blowing. Likewise, the airstream or blasted air is preferably generated at least substantially parallel, and more preferably parallel, with respect to the rectilinear path of the ejections. Alternatively, the airstream is preferably generated at least substantially perpendicular, and more preferably perpendicular, with respect to the rectilinear path of the ejections.

According to a fifth preferred embodiment, the shielding means comprise a substance, not depicted in the drawings, for being arranged or applied such that it receives and retains the spray of the ejected product impacting against same. The spray of the ejected product is thereby received and retained directly by said substance. This substance is a lacquer or a varnish, for example.

This substance is selected such that it is quick and easy to apply and remove, together with the spray of the product contained therein. A greater capacity to keep the curing elements (1.2) cleared of the sprayed product compared to the reception and retention of the sprayed product directly by the curing elements (1.2), and more specifically by the optical diffuser or the bulb thereof, is thereby provided by means of the substance.

The present digital print head comprises the shielding means according to the first or second preferred embodiment, where said embodiments can independently be combined with the third and/or fourth preferred embodiments.

Alternatively, the present digital print head comprises the shielding means according to the third embodiment, fourth embodiment, fifth embodiment, or any one combination of two or more of these preferred embodiments.

The first and second embodiments can independently be combined with the fifth embodiment, optionally together with one or more of the other embodiments. For this purpose, the curing elements (1.2) are arranged covered by the barrier elements (2.1), while at the same time the substance is arranged applied on the barrier elements (2.1).

With the barrier element (2.1) thereby being located between the curing element (1.2) and the substance, the substance can receive and retain the sprayed product, where only the substance or the substance and the barrier element (2.1) can be removed for the removal or elimination of the sprayed product with respect to the curing element (1.2). The spray of the product can therefore reach the barrier element (2.1), albeit indirectly.

The present digital printing machine for printing on the substrates comprises one or more of the digital print heads. With the digital print head being one in number, as described, said print head can be configured and arranged according to any one of the embodiments. With the digital print heads being several, at least two, in number, as described, all of them can be configured in the same way. Alternatively, with the digital print heads being several in number, as described, each of the digital print heads can be configured according to any one of the preferred embodiments.

The method for digital printing on the substrates uses one or more of the described digital print heads. Likewise, said method for digital printing on the substrates uses the digital printing machine as described.

The invention claimed is:

1. A digital print head for printing on substrates, comprising:

an ejector for ejecting a product onto the substrate;

a drying element for acting on the product ejected onto the substrate such that it is dried;

shielding means to prevent the ejected product from directly reaching the drying element by spray, wherein the drying element is located with respect to the ejector in such a way that when the product is ejected it may be subjected to the drying that may be provided by the drying element.

2. The head according to claim 1, wherein the drying element is a UV, UV-LED, or infrared radiation emission source.

3. The head according to claim 1, wherein the shielding means comprise an air pump for blasting air such that when the sprayed product is ejected it can be deviated with respect to the curing element.

4. The head according to claim 3, wherein the air pump is configured for generating the blast of air by blowing or by suction.

5. The head according to claim 1, wherein the shielding means comprise an electric charge generator for generating a static charge such that when the sprayed product is ejected the product is deviated with respect to the curing element.

6. The head according to claim 1, wherein the shielding means comprise a barrier element arranged in correspondence with the drying element such that the barrier element is reached by the sprayed product when ejected.

7. The head according to claim 6, wherein the barrier element is arranged for receiving the spray of the ejected product and for allowing the drying element to act on the product ejected onto the substrate.

8. The head according to claim 6, wherein the shielding means comprise a frame for carrying the barrier element and for being arranged supported on the base.

9. The head according to claim 6, wherein the barrier element is rigid, being made of a material that can be selected from the group consisting of crystal, glass, and plastic.

10. The head according to claim 6, wherein the barrier element is made of a plastic material and is configured such that it is elastically deformable.

11. The head according to claim 10, wherein the barrier element is arranged such that it can be fed by being unwound and wound for being arranged and removed, respectively, with respect to the drying element.

12. The head according to claim 10, wherein the barrier element is arranged such that it can be fed according to a closed path.

13. A digital printing machine for printing on substrates comprising a digital print head according to claim 12 and cleaning means configured for removing the sprayed product when ejected with respect to the barrier element.

14. The head according to claim 1, wherein the shielding means comprise a substance arranged for receiving the sprayed product, wherein the substance can be removably applied.

15. A method for digital printing on substrates comprising using the digital print head according to claim 1.

* * * * *